US006595318B2

(12) United States Patent
Ebinger et al.

(10) Patent No.: US 6,595,318 B2
(45) Date of Patent: Jul. 22, 2003

(54) DOUBLE-WALLED TAIL PIPE FOR AN EXHAUST PIPE OF A MOTOR VEHICLE EXHAUST SYSTEM

(75) Inventors: Günther Ebinger, Backnang (DE); Klaus Kubatschka, Reichenbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/965,911

(22) Filed: Sep. 28, 2001

(65) Prior Publication Data

US 2002/0053483 A1 May 9, 2002

Related U.S. Application Data

(63) Continuation-in-part of application No. PCT/EP00/02469, filed on Mar. 21, 2000.

(30) Foreign Application Priority Data

Mar. 30, 1999 (DE) ..... 199 14 426

(51) Int. Cl.[7] ..... F01N 7/08; B60K 13/04

(52) U.S. Cl. ..... 181/227; 181/228; 180/309

(58) Field of Search ..... 181/227, 228, 181/213, 218, 229, 247–251, 283; 180/309

(56) References Cited

U.S. PATENT DOCUMENTS 4,487,289 A * 12/1984 Kicinski et al. ..... 181/252
4,638,632 A * 1/1987 Wulf et al. ..... 60/319
4,969,537 A * 11/1990 Wagner et al. ..... 181/255
5,220,137 A * 6/1993 Howerton et al. ..... 181/264
5,321,215 A * 6/1994 Kicinski ..... 181/211
5,466,900 A * 11/1995 Knapp ..... 181/227
5,831,223 A * 11/1998 Kesselring ..... 181/227
5,934,959 A * 8/1999 Inman et al. ..... 440/89
6,116,377 A * 9/2000 Dugan ..... 181/272

FOREIGN PATENT DOCUMENTS

DE 78 38 091 7/1979
EP 0 848 144 6/1998
JP 62131927 A * 6/1987 ..... F02C/7/18
JP 63029007 A * 2/1988 ..... F01N/1/08
JP 07102967 A * 4/1995 ..... F01N/7/16
JP 08 284657 10/1996
JP 2000328924 A * 11/2000 ..... F01N/1/00

* cited by examiner

*Primary Examiner*—Robert E. Nappi
*Assistant Examiner*—Patrick Miller
(74) *Attorney, Agent, or Firm*—Klaus J. Bach

(57) ABSTRACT

In a double-wall tail pipe for an exhaust pipe of a motor vehicle exhaust system comprising an inner shell to be mounted on the exhaust pipe, an outer shell surrounding the inner shell and being supported thereon in spaced relationship to form an annular air space therebetween for conducting cooling air therethrough, a support structure provided with air passages is disposed between the inner and the outer shells in an area where the inner shell is seated on the exhaust pipe when the tail pipe is mounted on the exhaust pipe which support structure interconnects the inner and outer shells in an area which is spaced from the discharge end of the tail pipe.

17 Claims, 2 Drawing Sheets

DOUBLE-WALLED TAIL PIPE FOR AN EXHAUST PIPE OF A MOTOR VEHICLE EXHAUST SYSTEM

This is a Continuation-In-Part application of International Application PCT/EP00/02469 filed Mar. 21, 2000 and claiming the priority of German application 199 14 426.5 filed Mar. 30, 1999.

BACKGROUND OF THE INVENTION

The invention relates to a double-walled tailpipe for an exhaust pipe of a motor vehicle exhaust system with an inner shell on which an outer shell is supported in spaced relationship so as to permit air to flow through the gap between the inner and the outer shells and which can be mounted onto an exhaust pipe.

Double-walled tail pipes are known for example from DE 196 51 608 C2 and the corresponding EP 0 848 144 A1. The inner and outer shells are interconnected at the discharge end by engagement of the inner shell with the inwardly bent end edge of the outer shell to which the inner shell is welded. Otherwise, the inner and outer shells are not in contact with each other. The tail pipe is mounted onto the exhaust pipe by sliding the inner shell onto the exhaust pipe. Between the inner and outer shells, there is an annular space, which is open at the front end in the travel direction of the vehicle. At the rear exit end of the annular space, the tail pipe is provided with outlet slots, which are provided in the inwardly bent edge of the outer shell and extend annularly. In the embodiment shown, the heat transfer from the exhaust pipe of the exhaust system to the tail pipe mounted thereon is reduced in that the inner shell is supported by the exhaust pipe only by longitudinal and transverse projections which extend around window-like openings so that direct communication with the air gap is provided for and the heat radiated from the exhaust pipe is carried away partly by the air flowing through the air gap. However, at the exhaust end of the tail pipe, and in the visible area thereof, the inner and outer shells are directly interconnected so that the end section of the tail pipe may be heated in spite of the air flow through the space between inner and the outer shells and the cooling effect achieved thereby. Such heating, particularly at the end of the tail pipe, may lead to undesirable visible discoloration of the tailpipe also in the area of the outer shell. In addition, the connection between the inner and the outer shells as provided by this arrangement is critical also from a manufacturing point of view because, at its location exposed to an observer, it requires optically perfect manufacturing of the connection.

DE 78 38 091 U1 discloses a single wall tail pipe, that is a shield tube, which can be inserted axially onto an exhaust pipe and supported thereon by way of a spring structure, wherein the support, at the same time, fixes the tail pipe axially with respect to the exhaust pipe. The spring support is provided by a spring strip provided with spring webs which extend therefrom outwardly and are disposed in the overlapping area with the exhaust pipe and provide support on the exhaust pipe and also allow an adaptation to different exhaust pipe diameters. In this way, the tail pipe can be mounted onto exhaust pipes of a certain diameter range. However, the air gap between the exhaust pipe and the tail pipe, depends on the respective diameter difference so that the air flow through the air gap may not be sufficient for appropriate cooling of the tail pipe.

It is the object of the present invention to provide a double-walled tail pipe of the kind as discussed above which however is easier to manufacture and which provides for improved cooling so that a discoloration of the tail pipe at least in the visible area, that is, of the outer shell of the tail pipe is avoided.

SUMMARY OF THE INVENTION

In a double-wall tail pipe for an exhaust pipe of a motor vehicle exhaust system comprising an inner shell to be mounted on the exhaust pipe, an outer shell surrounding the inner shell and being supported thereon in spaced relationship to form an annular air space therebetween for conducting cooling air therethrough, a support structure provided with air passages is disposed between the inner and the outer shells in an area where the inner shell is seated on the exhaust pipe when the tail pipe is mounted on the exhaust pipe, which support structure interconnects the inner and outer shells in an area which is spaced from the discharge end of the tail pipe.

In the tail pipe according to the invention, the connection between the inner and the outer tubular shells is disposed in an area in which the inner and outer shell are disposed on the exhaust pipe, that is, remote from the visible outer end of the tail pipe, and where the inner shell is supported on the exhaust pipe. The support is such that it includes air inlet openings which are disposed in the air gap or which provide for communication with the air gap.

In a preferred embodiment, which is also easy to manufacture the inner shell is provided, at its upstream end, with a radially outwardly extending flange by which it is supported on, and connected to, the exhaust pipe. The flange includes openings and engages, with its radially outer end, the inner wall of the outer shell. The flange may be an annular flange provided with openings but preferably, it is formed by circumferentially spaced, bent straps provided with mounting sections adapted in shape to the contour of the outer shell. Each strap has an angled end portion disposed adjacent the support portion which bridges the space between the inner and the outer shells. The bent straps preferably have, in a radial cross-section, a Z-shaped contour wherein the outer leg of the z forms the end portion of the strap with which it is mounted to the outer shell. The web of the z forms the support section and the inner leg of the z is formed by the area of the inner shell which is disposed on the exhaust pipe. The axial length of the overlapping area of the inner shell with the exhaust pipe may be limited for example by a stepped structure or by a stop provided on the inner shell.

The straps may include backwardly bent end portions so that they form U-shaped supports disposed between the exhaust pipe and the outer shell, wherein the free leg portion is supported on the exhaust pipe. In this way, a simple support structure may be provided which allows for some relative movement.

Since the support of the inner shell with respect to the outer shell is disposed in spaced relationship from the end of the overlap area with the exhaust pipe the support structure for the inner shell in the outer shell is disposed in the entrance area of the air gap so that the support structure is exposed to the lowest possible air temperature.

Furthermore, the overlap area between the inner shell and the exhaust pipe can be relatively short if, as in a particular embodiment, the outer shell extends at least in some area axially beyond the inner shell and is mounted in that area to the exhaust pipe for example by a bolt.

Such an additional mounting structure may be disposed in an area, which is not normally visible for example at the underside of the exhaust pipe. It is also within the scope of the invention to mount the inner shell on the exhaust pipe by providing securing means in the area of overlap between the inner shell and the exhaust pipe. This can be done for example by means of one or more clamping screws, which extend at least through the inner shell for engagement with the exhaust pipe. Such clamping screws may be provided also in the area of the flange, which supports the outer shell on the inner shell.

With the support arrangement according to the invention with a support of the inner shell on the outer shell in the overlap area with the exhaust pipe, preferably somewhat upstream of the support structure between the inner and outer shells, the support structure may not extend radially, but it may be inclined whereby the support straps become longer providing a longer path for the heat flow and an increased heat exchange area so that the heat transfer from the inner shell to the outer shell is substantially reduced.

From the contact area of the support structure with the inner shell in the overlap area of the inner shell with the exhaust pipe, the inner shell is not in contact with the outer shell and terminates also in spaced relationship, preferably with a small axial distance from the downstream radially inner end of the outer shell. The end of the outer shell is preferably rounded, that is it is rolled in, or inwardly flanged. If, in this case, the inner shell is adapted in diameter to the open cross-section at the end of the outer shell and the inner shell forms practically an extension of the inner end of the exhaust pipe, that is, the inner shell is somewhat smaller in diameter than the inner end of the inwardly extending end flange of the outer shell in which the inner shell is disposed, an additional suction effect is provided. As a result, the air flowing through the air gap forms a protective envelop between the exhaust gas and the outlet area, whereby heating of the outer shell is reduced and contamination caused by the exhaust gas and also temperature-caused discoloration of the end of the outer sleeve are avoided. The arrangement according to the invention can be realized also with a relatively short inner shell. Extensions of the outer shell beyond the inner shell can be formed in a funnel-like fashion for collecting the airflow directed to the air gap.

It is further possible by an adequate designing of the support structure between the inner and the outer shells, for example by providing a support flange, which is oversized with respect to the outer shell, to mount the inner shell in the outer shell by axially pressing the flange into the outer shell with a press fit. A welding connection in the visible area of the exhaust pipe or the tail pipe can be avoided in this way.

Additional connections such as welding may then only be provided for safety reasons. Such a safety connection may be provided by a spot weld of one or several straps of the support structure.

Additional details and features of the invention will be described below on the basis of the accompanying drawings.

DESCRIPTION OF A PREFERRED EMBODIMENT

Figure 1:
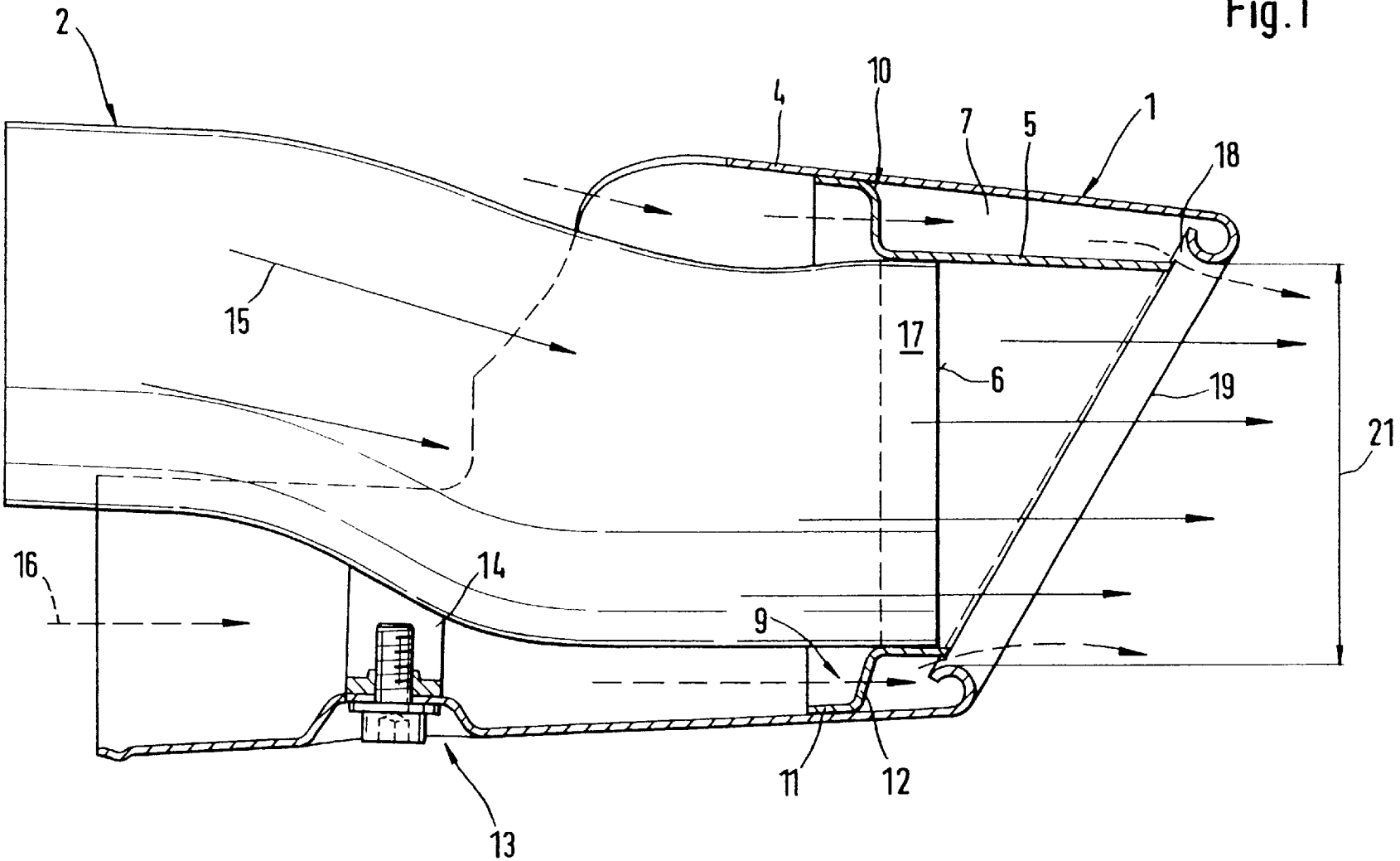
FIG. 1 is a cross-sectional view of a double-wall tail pipe disposed on an exhaust pipe of a vehicle exhaust system.

The figures show a double-wall tail pipe 1 disposed on an exhaust pipe of a vehicle exhaust system, which is not shown in detail. In the embodiment shown, the exhaust pipe 2 has an oval cross-section in the discharge area and is provided with a separation wall 3. This embodiment, which has at least optically two flow passages, however, is only exemplary. The invention is equally applicable to exhaust pipes with circular cross-section or other common cross-sections and with one or two flow passages.

The double-wall tail pipe includes an outer shell 4 and an inner shell 5 and is connected to the exhaust pipe 2 by way of the inner shell 5, which can be inserted over the exhaust pipe 2 and wherein the inner shell supports the outer shell.

Figure 2:
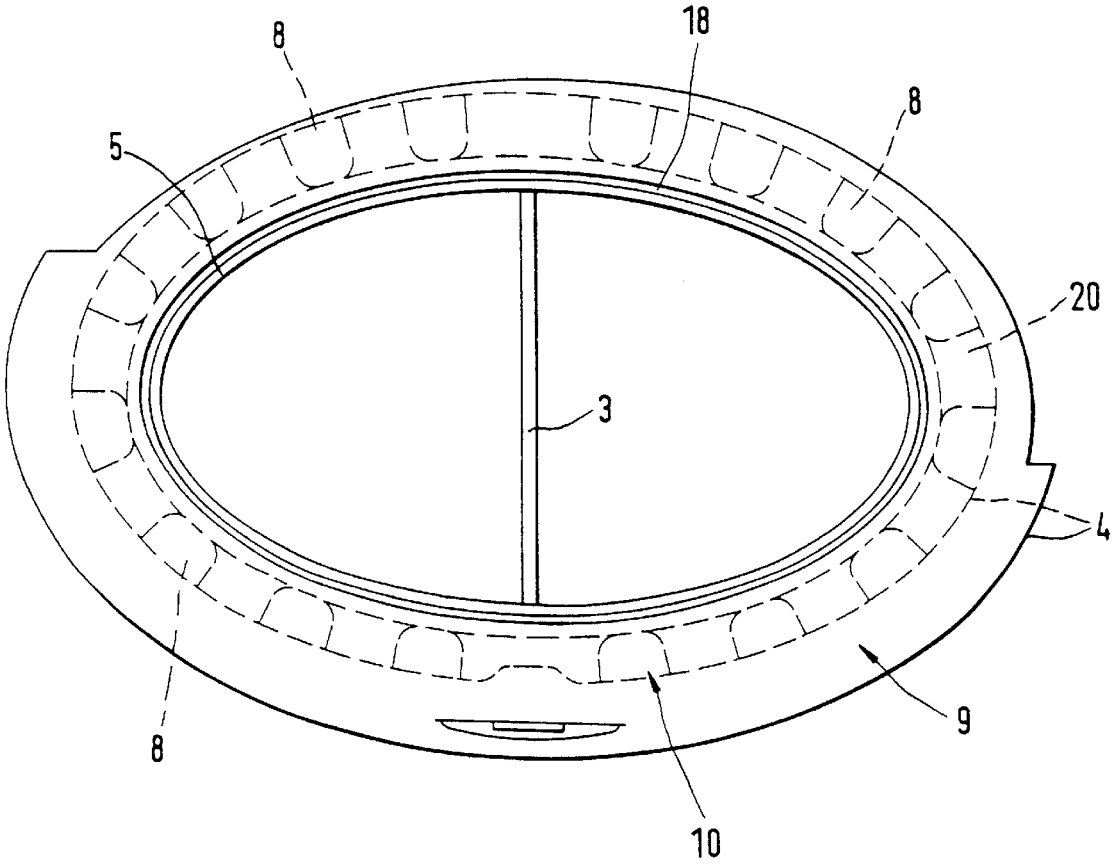
FIG. 2 is a view of the double-walled tail pipe as shown in FIG. 1 presented here partially schematically.

The inner shell 5 is placed onto the exhaust pipe 2 by sliding the shell 5 onto the exhaust pipe from the free end 6 thereof. The slide-in distance may be limited by a shoulder or another stop, which may extend from the inner surface of the inner shell 5. The stop may be formed by a projection stamped into the inner shell 5. The insertion length of the inner shell 5 over the exhaust pipe 2 is relatively short and corresponds in the embodiment shown about to the radial width of the air gap 7 formed between the inner shell 5 and the outer shell 4. The outer shell 4 is supported on the inner shell 5 by an annular radial support structure 9, which is provided with air inlet passages 8. In the embodiment shown, the radial support structure 9 is formed by a flange 10, which extends around the inner shell 5 and which includes an axially extending mounting portion 11. The mounting portion forms the outer end of a support section 12 that bridges the gap between the inner shell 5 and the outer shell 4. This support section 12 is provided with air flow passages 8. The flange 10, however, could also consist of circumferentially spaced support straps 20 (FIG. 2) which, in the cross-section as shown in FIG. 1, have a Z-shaped contour, wherein the outer Z leg forms the axially extending mounting section 11. The radial web of the Z-shaped cross-section forms a support member 12 and the inner leg is formed by the inner shell 5. FIG. 1 shows that the length of the axial mounting section 11 is about equal the width of the mounting area 17 by way of which the inner shell 5 of the tail pipe 1 is supported on the exhaust pipe 2.

With the arrangement as described above, wherein the outer shell 4 is supported by the inner shell 5 in an area which is disposed, with respect to the exhaust gas and the cool air flowing in the same direction, upstream of the free end 6 of the exhaust gas pipe and also upstream of the insert connection 17 of the inner shell 5 with the exhaust pipe 2, the heat input to the outer shell 4 by way of the support straps 12 is low because of the good cooling achieved with the arrangement.

Intense cooling and low heating of the outer shell 4 is enhanced by the air gap 7, which is in communication with the ambient by an annular gap 18 in the end portion of the tail pipe 1. The annular gap 18 is disposed between the outer circumference of the inner shell 5, which ends a small distance ahead of the discharge end 19 of the outer shell 4. In this end area, the outer shell 4 is bent inwardly and the inwardly bent end section of the outer shell surrounds the exhaust gas discharge opening. The flow cross-section of the discharge opening is indicated in FIG. 1 by the reference numeral 21. The outer shell extends inwardly close to the outer circumference of the inner shell 5 and forms a covered structure defining a nozzle that generates in the discharge area a suction increasing the flow of cooling air through the air gap 7.

As a result, the exhaust gas flow 15 is kept separated from the discharge end of the outer end so that the outer shell is not excessively heated by the exhaust gas flow and, furthermore, deposits on the tail pipe and discolorations thereof in the visible area of the outer shell are avoided. The free cross-section of the annular gap 18 is preferably smaller than the cross-section of the air gap 7, particularly of the entrance area thereof.

Preferably, the inner shell and the outer shell consist of stainless steel.

What is claimed is:

1. A double-wall tail pipe for an exhaust pipe of a motor vehicle exhaust system comprising: an inner shell for mounting onto said exhaust pipe at one end thereof, an outer shell ex-tending around, and being supported on, said inner shell in spaced relationship therefrom so as to form between said inner and outer shells an annular air space for air to flow therethrough for cooling said outer shell, a support structure provided with air passages and being disposed in said air space for supporting said inner and outer shells in spaced relationship from each other, said support structure being disposed in an area of said inner shell adjacent the end portion of said inner shell, which is seated on said exhaust pipe when said tail pipe is mounted on said exhaust pipe, said air passages in said support structure forming air inlet openings for directing air into the annular air space and said outer shell being bent inwardly at its end to form a curved end structure and said inner shell ending in axially spaced relationship from said curved end structure of said outer shell so as to form a flow gap between the end of said inner shell and said curved end structure through which a cool air flow leaves said annular air space while enveloping the exhaust gas being discharged through said inner shell thereby maintaining said curved end structure cool and free from deposits.

2. A double-wall tail pipe for an exhaust pipe according to claim 1, wherein said support structure is formed by a flange structure which extends from, and is supported on, said inner shell, said flange structure being widened radially outwardly.

3. A double-wall tail pipe for an exhaust pipe according to claim 2, wherein said flange structure is formed by an outwardly bent end portion of said inner shell.

4. A double-wall tail pipe for an exhaust pipe according to claim 2, wherein said flange structure is formed by circumferentially spaced straps.

5. A double-wall tail pipe for an exhaust pipe according to claim 2, wherein said flange structure includes a mounting section which is adapted in shape to the contour of the outer shell for firm engagement therewith.

6. A double-wall tail pipe for an exhaust pipe according to claim 5, wherein said mounting section is supported by a support section which extends radially across the space between said inner and said outer shells.

7. A double-wall tail pipe for an exhaust pipe according to claim 2, wherein said flange structure is in the form of a step.

8. A double-wall tail pipe for an exhaust pipe according to claim 2, wherein said inner shell is tightly fitted with said flange structure into said outer shell so as to be firmly engaged therein.

9. A double-wall tail pipe for an exhaust pipe according to claim 8, wherein said flange structure is press-fitted into said outer shell.

10. A double-wall tail pipe for an exhaust pipe according to claim 8, wherein said flange structure is welded to said outer shell.

11. A double-wall tail pipe for an exhaust pipe according to claim 1, wherein said axial distance between said inner shell end and said curved end structure of said outer shell corresponds to the radial width of said annular air space at least over part of the circumference thereof.

12. A double-wall tail pipe for an exhaust pipe according to claim 1, wherein the axial distance between said inner shell and said curved end structure is less than the radial width of said annular air space.

13. A double-wall tail pipe for an exhaust pipe according to claim 11, wherein the axial distance between said inner shell and said curved end structure corresponds about to the diameter of said curved end structure at least over part of the circumference thereof.

14. A double-wall tail pipe for an exhaust pipe according to claim 1, wherein the outer diameter of said inner shell corresponds about to the inner diameter of the curved end structure of said outer shell.

15. A double-wall tail pipe for an exhaust pipe according to claim 1, wherein the outer diameter said inner shell is smaller than the inner diameter of the curved end structure of said outer shell.

16. A double-wall tail pipe for an exhaust pipe according to claim 15, wherein said inner shell is smaller in its dimensions than the open width of said curved end structure by about the thickness of the wall of the inner shell.

17. A double-wall tail pipe for an exhaust pipe according to claim 1, wherein said inner and said outer shells consist of stainless steel.

* * * * *